US011230104B2

(12) United States Patent
Kakiuchi

(10) Patent No.: US 11,230,104 B2
(45) Date of Patent: Jan. 25, 2022

(54) LIQUID DISCHARGING HEAD

(71) Applicant: BROTHER KOGYO KABUSHIKI KAISHA, Nagoya (JP)

(72) Inventor: Toru Kakiuchi, Aichi-ken (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/073,913

(22) Filed: Oct. 19, 2020

(65) Prior Publication Data

US 2021/0155000 A1 May 27, 2021

(30) Foreign Application Priority Data

Nov. 27, 2019 (JP) ..... JP2019-213858

(51) Int. Cl.
*B41J 2/16* (2006.01)
*B41J 2/14* (2006.01)

(52) U.S. Cl.
CPC ..... *B41J 2/1625* (2013.01); *B41J 2/14201* (2013.01); *B41J 2002/14475* (2013.01); *B41J 2202/11* (2013.01)

(58) Field of Classification Search
CPC ..... B41J 2/14201; B41J 2/14209; B41J 2/14233; B41J 2/14274; B41J 2/14282; B41J 2002/14241; B41J 2/1429; B41J 2/14298; B41J 2002/14217; B41J 2002/14225; B41J 2002/1425; B41J 2002/14266; B41J 2002/14306; B41J 2/1625; B41J 2202/11; B41J 2002/14475
See application file for complete search history.

(56) References Cited

U.S. PATENT DOCUMENTS 6,412,926 B1 7/2002 Okuda
2010/0097423 A1* 4/2010 Inoue ..... B41J 2/14274 347/47
2017/0274652 A1* 9/2017 Tamai ..... B41J 2/1606
2019/0389208 A1* 12/2019 Sugai ..... B41J 2/175

FOREIGN PATENT DOCUMENTS

JP 2000-117972 A 4/2000

* cited by examiner

*Primary Examiner* — Kristal Feggins
(74) *Attorney, Agent, or Firm* — Merchant & Gould P.C.

(57) ABSTRACT

A liquid discharging head includes: a channel unit having a liquid channel which includes: a nozzle arranged at an end part, of the channel unit, on one side in a first direction; and a pressure chamber arranged at an end part, of the channel unit, on the other side in the first direction and communicating with the nozzle; and a piezoelectric element including: a vibration plate arranged on a surface, of the channel unit, on the other side in the first direction and covering the pressure chamber; and a piezoelectric layer arranged on a surface, of the vibration plate, on the other side in the first direction. An area, of the pressure chamber, which is projected in the first direction is not more than 50000 $\mu m^2$, and a diameter of the nozzle is increased from the one side toward the other side in the first direction.

10 Claims, 9 Drawing Sheets

STRAIGHT
CONTACT ANGLE 20°

STRAIGHT
CONTACT ANGLE 80°

LIQUID DISCHARGING HEAD

CROSS REFERENCE TO RELATED APPLICATION

The present application claims priority from Japanese Patent Application No. 2019-213858, filed on Nov. 27, 2019, the disclosure of which is incorporated herein by reference in its entirety.

BACKGROUND

Field of the Invention

The present disclosure relates to a liquid discharging head configured to discharge liquid from a nozzle.

Description of the Related Art

As a liquid discharging head which discharges liquid from a nozzle, there is a known ink-jet recording head which discharges ink from a nozzle. In the known ink-jet recording head, a pressure chamber communicating with the nozzle is formed to have a width which is 320 μm, a height which is 140 and a length which is 2.5 mm, and to have a taper angle of an inner wall surface of the nozzle which is not less than 10 degrees. Further, in the known ink-jet recording head, the size of the pressure chamber and the taper angle of the inner wall surface of the nozzle are made to be as described above, thereby making it possible to drive the ink-jet recording head at a driving frequency of approximately 10 kHz.

SUMMARY

Here, the liquid discharging head is required to further reduce the size of the pressure chamber and to further increase the driving frequency, from the viewpoint of increasing the speed of discharge and of further reducing the size of the device. However, in the above-described ink-jet recording head, in a case that the size of the pressure chamber is further reduced and that the driving frequency is increased, there is such a fear that the discharge of the liquid from the nozzle might become unstable.

An object of the present disclosure is to provide a liquid discharging head capable of stably discharging liquid from the nozzle even in a case that the size of the pressure chamber is reduced and that the driving frequency is increased.

According to an aspect of the present disclosure, there is provided a liquid discharging head including: a channel unit having a liquid channel which includes: a nozzle arranged at an end part, of the channel unit, on one side in a first direction; and a pressure chamber arranged at an end part, of the channel unit, on the other side in the first direction and communicating with the nozzle; and a piezoelectric element including: a vibration plate arranged on a surface, of the channel unit, on the other side in the first direction and covering the pressure chamber; and a piezoelectric layer arranged on a surface, of the vibration plate, on the other side in the first direction, wherein an area, of the pressure chamber, which is projected in the first direction is not more than 50000 $\mu m^2$, a diameter of the nozzle is increased from the one side toward the other side in the first direction, and a relationship of: $\theta+1.5\times10^{-4}\times S>11$ is satisfied, provided that θ is an inclination angle of an inner wall surface of the nozzle with respect to the first direction, and that the area of the pressure chamber is S $\mu m^2$.

DESCRIPTION OF THE EMBODIMENTS

An embodiment of the present disclosure will be explained below.

<Overall Configuration of Ink-Jet Printer 1>

Figure 1:
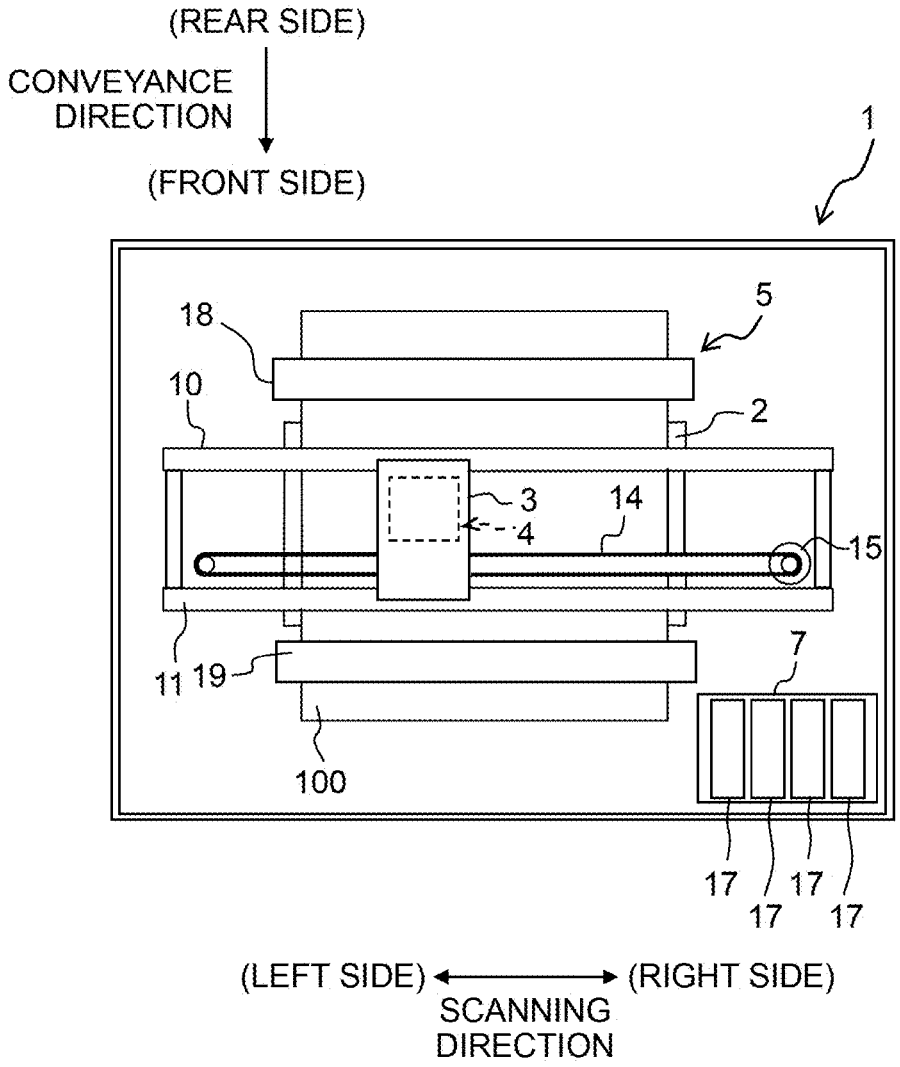
FIG. 1 is a view schematically depicting the configuration of a printer related to an embodiment of the present disclosure.

As depicted in FIG. 1, a printer 1 according to the present embodiment is provided with a carriage 3, an ink-jet head 4 (corresponding to a liquid discharging head of the present disclosure) and a conveying mechanism 5.

The carriage 3 is attached to two guide rails 10 and 11 which extend in a scanning direction (corresponding to a second direction of the present disclosure) which is horizontal. Further, the carriage 3 is connected to a carriage driving motor 15 via an endless belt 14. The carriage 3 is driven by the carriage driving motor 15 so as to move in a reciprocating manner in the scanning direction, at a location above a recording sheet 100 on the platen 2. Note that in the following, the explanation will be given while defining the right and left sides in the scanning direction as depicted in FIG. 1.

The ink-jet head 4 is mounted on the carriage 3. Four color inks (black, yellow, cyan, and magenta inks) are supplied from ink cartridges 17, respectively, of a holder 7 to the ink-jet head 4, via tubes (not depicted in the drawings), respectively. The ink-jet head 4 discharges or ejects the ink(s) from a plurality of nozzles 24 (see FIGS. 2 to 6) toward the recording sheet 100 on the platen 2, while moving in the scanning direction together with the carriage 3.

The conveying mechanism 5 conveys the recording sheet 100 on platen 2 by two conveying rollers 18 and 19 in a conveyance direction (corresponding to a third direction of the present disclosure) which is horizontal and which is orthogonal to the scanning direction. In the following, the explanation will be made while defining the front and rear sides in the conveyance direction, as depicted in FIG. 1.

<Ink-Jet Head 4>

Figure 2:
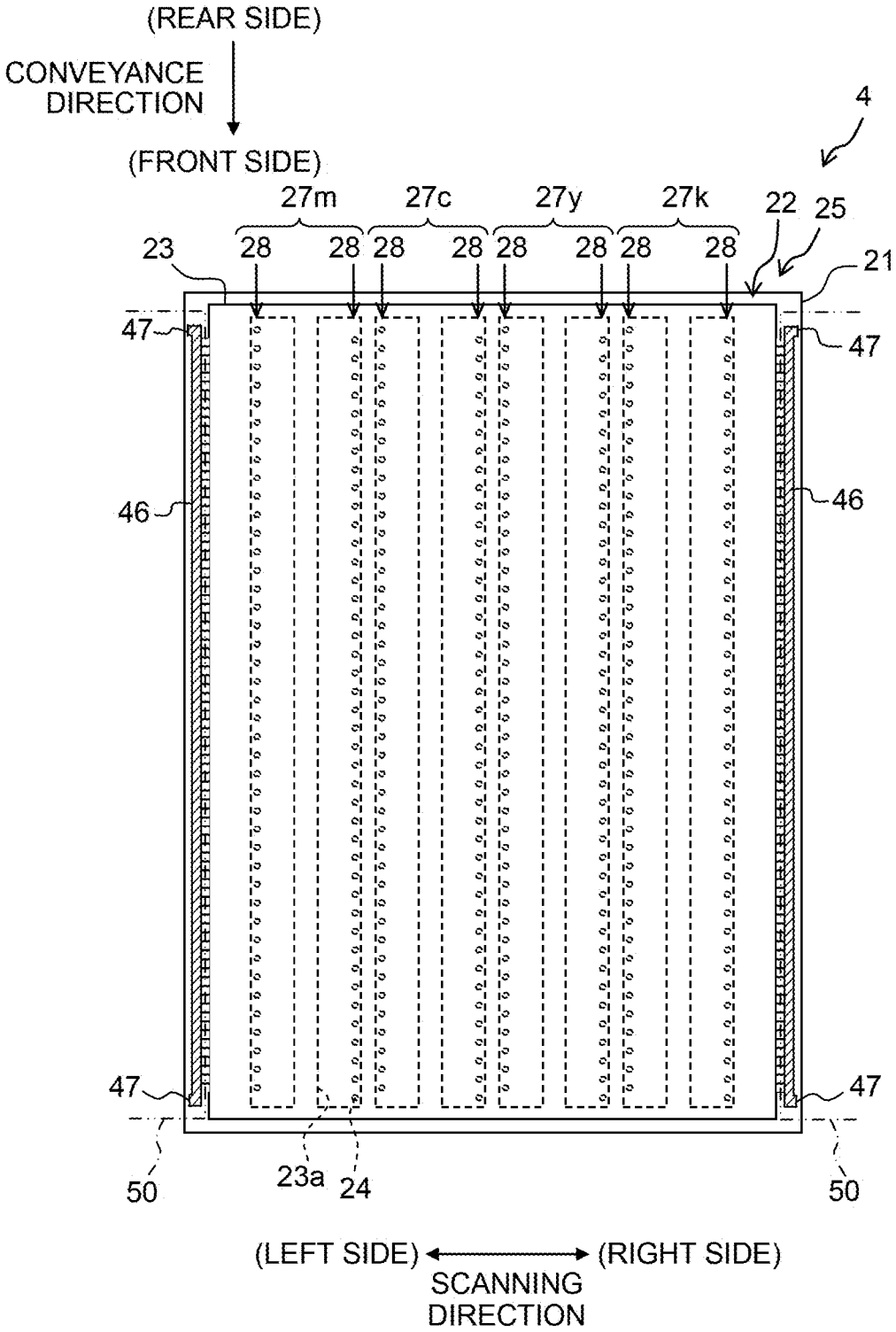
FIG. 2 is a plan view of an ink-jet head depicted in FIG. 1.

Next, the configuration of the ink-jet head 4 will be explained in detail, with reference to FIGS. 2 to 6. Note that in FIGS. 3 and 4, a protective member 23 depicted in FIG. 2 is omitted in the illustration.

The inks of four colors (black, yellow, cyan, and magenta) are ejected from the ink-jet head 4 of the present embodiment. As depicted in FIGS. 2 to 6, the ink-jet head 4 includes a nozzle plate 20, a channel member 21, and an actuator device 25 including a piezoelectric actuator 22. Note that in the present embodiment, a combination of the nozzle plate 20 and the channel member 21 corresponds to a channel unit of the present disclosure.

<Nozzle Plate 20>

The nozzle plate 20 is a plate formed of silicon and having a thickness which is in a range of about 30 μm to about 60 The plurality of nozzles 24 aligned in the conveyance direction are formed in the nozzle plate 20. With this, in the present embodiment, the plurality of nozzles 24 are arranged at a lower end part (corresponding to an end part on one side of the present disclosure) in the up-down direction (corresponding to a first direction of the present disclosure) of the channel unit.

Figure 3:
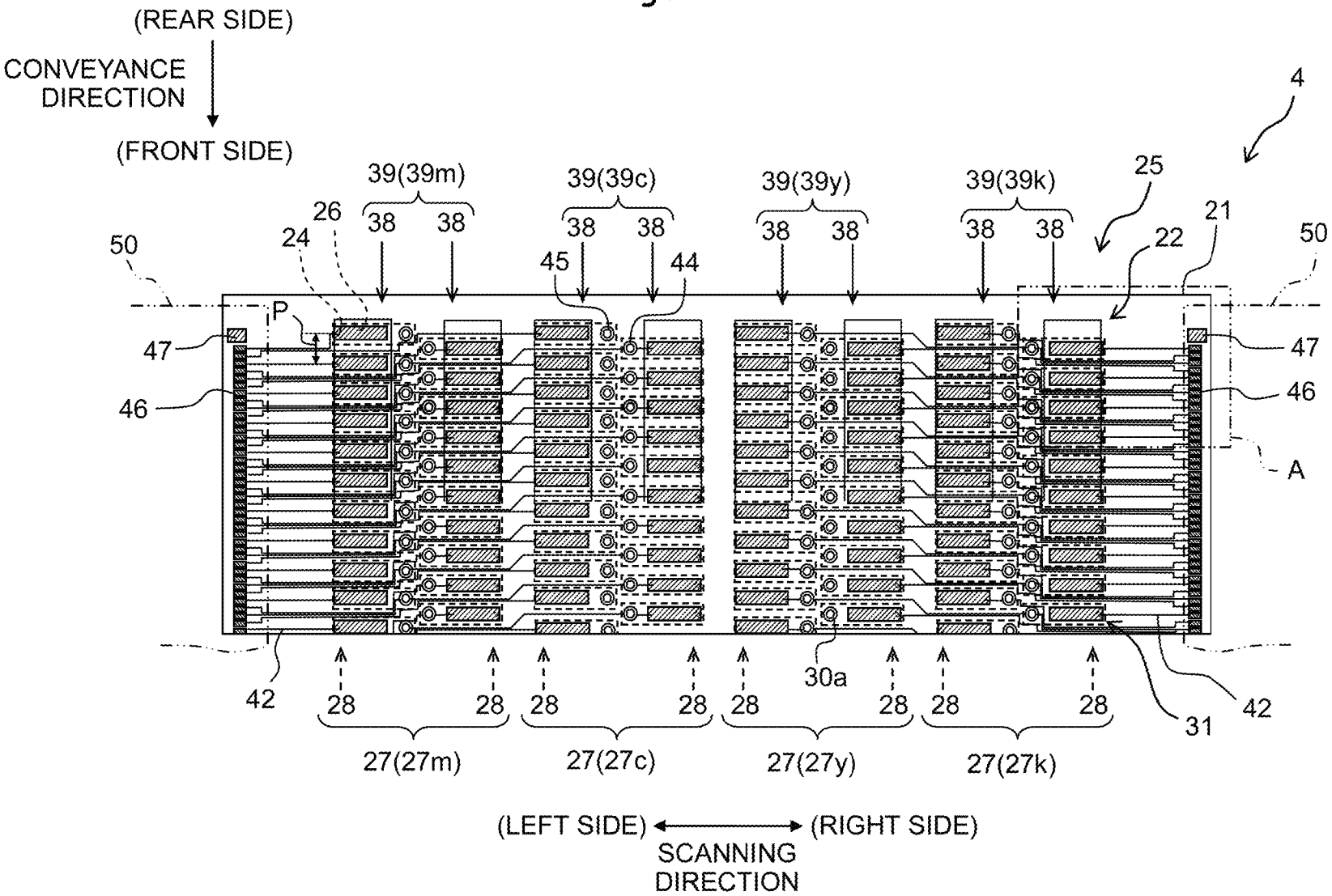
FIG. 3 is an enlarged view of a rear end part of the ink-jet head depicted in FIG. 2.

To provide a more specific explanation of the arrangement of the plurality of nozzles 24, as depicted in FIGS. 2 and 3, four nozzle groups 27 arranged side by side in the scanning direction are formed in the nozzle plate 20. The four nozzle groups 27 discharge inks of mutually differing colors, respectively. One nozzle group 27, among the four nozzle groups 27, is constructed of two left and right nozzle rows 28. In each of the nozzle rows 28, the plurality of nozzles 24 are aligned in an alignment pitch P of which density is not less than 300 dpi. In addition, between the two nozzle rows 28, the positions of the nozzles 24 are shifted by half the pitch P (P/2) in the conveyance direction. Namely, the plurality of nozzles 24 forming one nozzle group 27 are arranged in a staggered manner so as to form two rows.

Figure 7A:
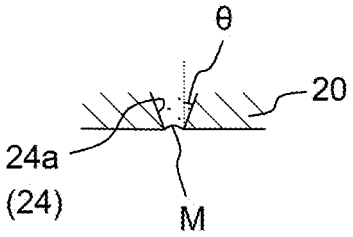
FIG. 7A is a view for explaining a meniscus of an ink in a nozzle in a case that the nozzle is tapered.
Figure 7B:
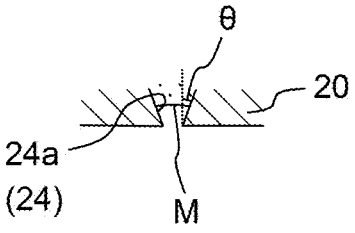
FIG. 7B is a view indicating a state, in the case that the nozzle is tapered, that the meniscus of the ink in the nozzle is located above that depicted in FIG. 7A.

Further, each of the plurality of nozzles 24 is formed in a tapered shape so that the diameter thereof is increased from the lower side toward the upper side (corresponding to "from one side toward the other side in the first direction" of the present disclosure); as depicted in FIGS. 7A and 7B, an inner wall surface 24*a* of each of the plurality of nozzles 24 is inclined by an inclination angle θ with respect to the up-down direction. The inclination angle θ will be explained later in detail. Further, a contact angle of the inner wall surface 24*a* of the nozzle 24 with respect to the ink is not more than 80°.

Note that in the following explanation, among the constituent elements of the ink-jet head 4, constituent elements corresponding to the black, yellow, cyan and magenta inks are denoted, respectively, by a symbol "k" indicating black, a symbol "y" indicating yellow, a symbol "c" indicating cyan, and a symbol "m" indicating magenta which are added to the reference numerals indicating the constituent elements, as appropriate, so as to clarify as to each constituent element corresponds to which ink among the four color inks. For example, a nozzle group 27*k* refers to the nozzle group 27 discharging the black ink.

<Channel Member 21>

The channel member 21 is a silicon single crystal-substrate having a thickness which is in a range of about 50 μm to about 150 As depicted in FIGS. 2 to 6, a plurality of pressure chambers 26 communicating with the plurality of nozzles 24, respectively, are formed in the channel member 21. Each of the plurality of pressure chambers 26 has a rectangular planar shape which is long in the scanning direction. The plurality of pressure chambers 26 are aligned in the conveyance direction at an alignment pitch P (of which density is not less than 300 dpi) same as that in the alignment of the plurality of nozzles 24 as described above, and the plurality of pressure chambers 26 construct two pressure chamber rows with respect to one of the four color inks, constructing eight pressure chamber rows in total. The lower surface of the channel member 21 is covered with the nozzle plate 20. Further, an end part on the outer side in the scanning direction of each of the plurality of pressure chambers 26 overlaps with one of the plurality of nozzles 24. Thus, in the present embodiment, the plurality of pressure chambers 26 are arranged an end part on the upper side (corresponding to "the other side in the first direction" of the present disclosure) of the channel unit.

Further, a length L in the scanning direction of each of the plurality of pressure chambers 26 is about 590 μm (not more than 1000 μm), and a width W (length in the conveyance direction of each of the plurality of pressure chambers 26 is about 65 μm (not more than 80 μm). Thus, in the present embodiment, an area S, of each of the plurality of pressure chambers 26, which is projected in the up-down direction is about 38350 $\mu m^2$ (not more than 50000 $\mu m^2$).

Note that a vibration film 30, which is one of the constituent components of a piezoelectric actuator 22 which will be described later, is arranged on the upper surface of the channel member 21 so as to cover the plurality of pressure chambers 26. The vibration film 30 is not particularly limited, under a condition that the vibration film 30 is an insulating film covering the plurality of pressure chambers 26. For example, in the present embodiment, the vibration film 30 is a film formed by oxidizing or nitriding a surface of a silicon substrate. An ink supply hole 30*a* is formed in a part, of the vibrating film 30, covering an end part on the inner side in the scanning direction (an end part on the opposite side to one of the plurality of the nozzles 24) of each of the plurality of pressure chambers 26. Further, a thickness D1 of the vibration film 30 is in a range of about 1 μm to about 3 μm.

<Actuator Device 25>

An actuator device 25 is arranged on the upper surface of the channel member 21. The actuator device 25 has: the piezoelectric actuator 22 including a plurality of piezoelectric elements 31; a protective member 23; and two COFs 50.

Figure 4:
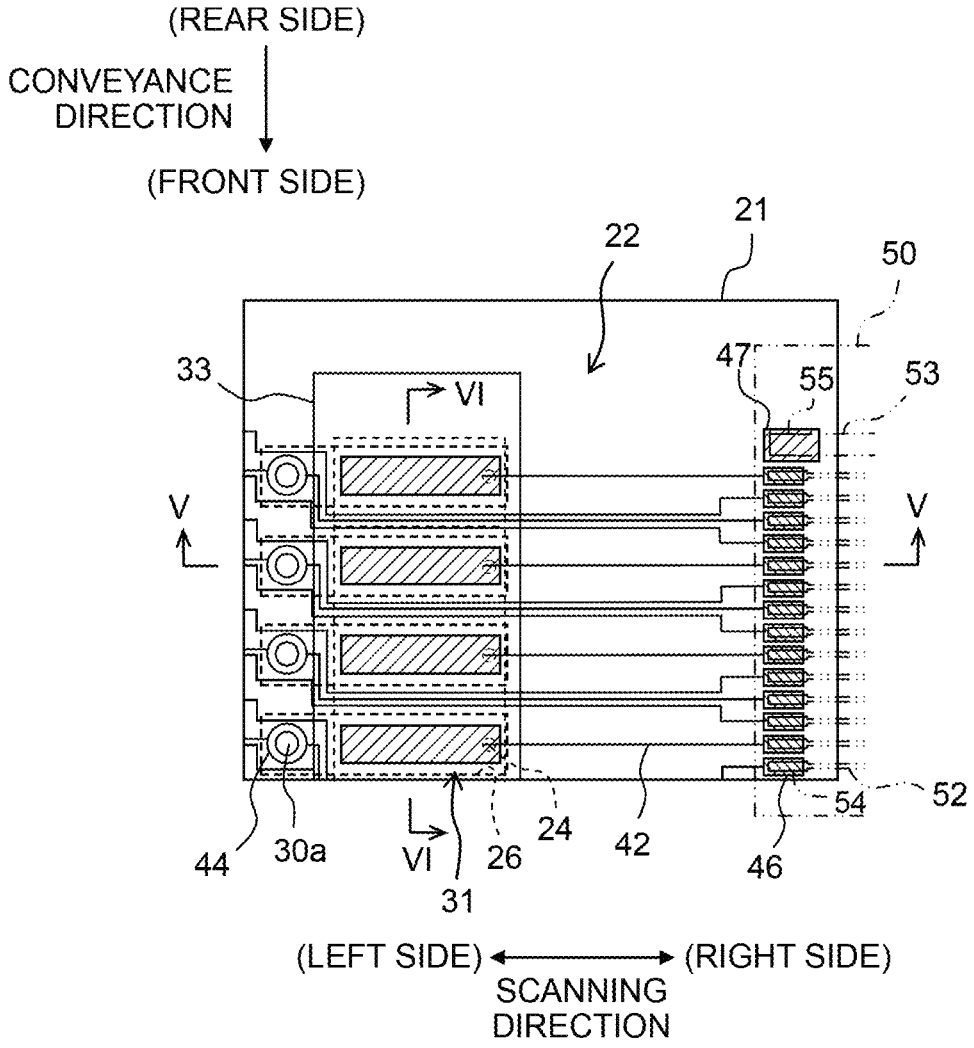
FIG. 4 is an enlarged view of an "A" part in FIG. 3.

The piezoelectric actuator 22 is arranged over the entire area of the upper surface of the channel member 21. As depicted in FIGS. 3 and 4, the piezoelectric actuator 22 has the plurality of piezoelectric elements 31 arranged while overlapping with the plurality of pressure chambers 26, respectively. The plurality of piezoelectric elements 31 are aligned in the conveyance direction according to the alignment of the plurality of pressure chambers 26 and construct eight piezoelectric element rows 38. From four piezoelectric element rows 38 on the left side among the eight piezoelectric element rows 38, a plurality of driving contacts 46 and two ground contacts 47 are pulled to the left side; as depicted in FIGS. 2 and 3, the plurality of driving contacts 46 and the two ground contacts 47 are arranged at a left end part of the channel member 21. From four piezoelectric element rows 38 on the right side among the eight piezoelectric element rows 38, a plurality of driving contacts 46 and two ground contacts 47 are pulled to the right side; the plurality of driving contacts 46 and the two ground contacts 47 are arranged at a right end part of the channel member 21. The detailed configuration of the piezoelectric actuator 22 will be described later.

The protective member 23 is arranged on the upper surface of the piezoelectric actuator 22 so as to cover the plurality of piezoelectric elements 31. Specifically, the protective member 23 covers the eight piezoelectric element rows 38 individually by eight concave protective parts 23*a*. Note that as depicted in FIG. 2, the protective member 23 does not cover both end parts on the left and right sides of the piezoelectric actuator 22, and the plurality of driving contacts 46 and the two ground contacts 47 of the piezoelectric actuator 22 are exposed from the protective member 23. Further, the protective member 23 has four reservoirs 23*b* (corresponding to a common channel of the present disclosure) connected to the four ink cartridges 17 of the holder 7. The ink in each of the reservoirs 23*b* is supplied to one of the plurality of pressure chambers 26 from the ink supply hole 30*a* formed in the vibrating film 30 via a throttle channel 23*c*.

Each of the two COFs 50 depicted in FIGS. 2 to 5 is a flexible trace member having a substrate 56 formed of an insulating material such as a polyimide film, etc. A driver IC 51 is mounted on the substrate 56. One end parts of the two COFs 50 are connected to a controller (not depicted in the drawings) of the printer 1. The other end parts of the two COFs 50 are joined to both end parts, respectively, on the left and right sides of the piezoelectric actuator 22. As depicted in FIG. 4, each of the two COFs 50 has a plurality of individual traces 52 connected to the driver IC 51 and a ground trace 53. A individual contact 54 is provided at a forward end part of each of the plurality of individual traces 52, and the individual contact 54 is connected to a driving contact 46 of the piezoelectric actuator 22. A ground connection contact 55 is provided at a forward end part of the ground trace 53, and the ground connection contact 55 is connected to a ground contact 47 of the piezoelectric actuator 22. The driver IC 51 outputs, via the individual contact 54 and the driving contact 46, a driving signal to each of the plurality of piezoelectric elements 31 of the piezoelectric actuator 22.

<Piezoelectric Actuator 22>

Figure 5:
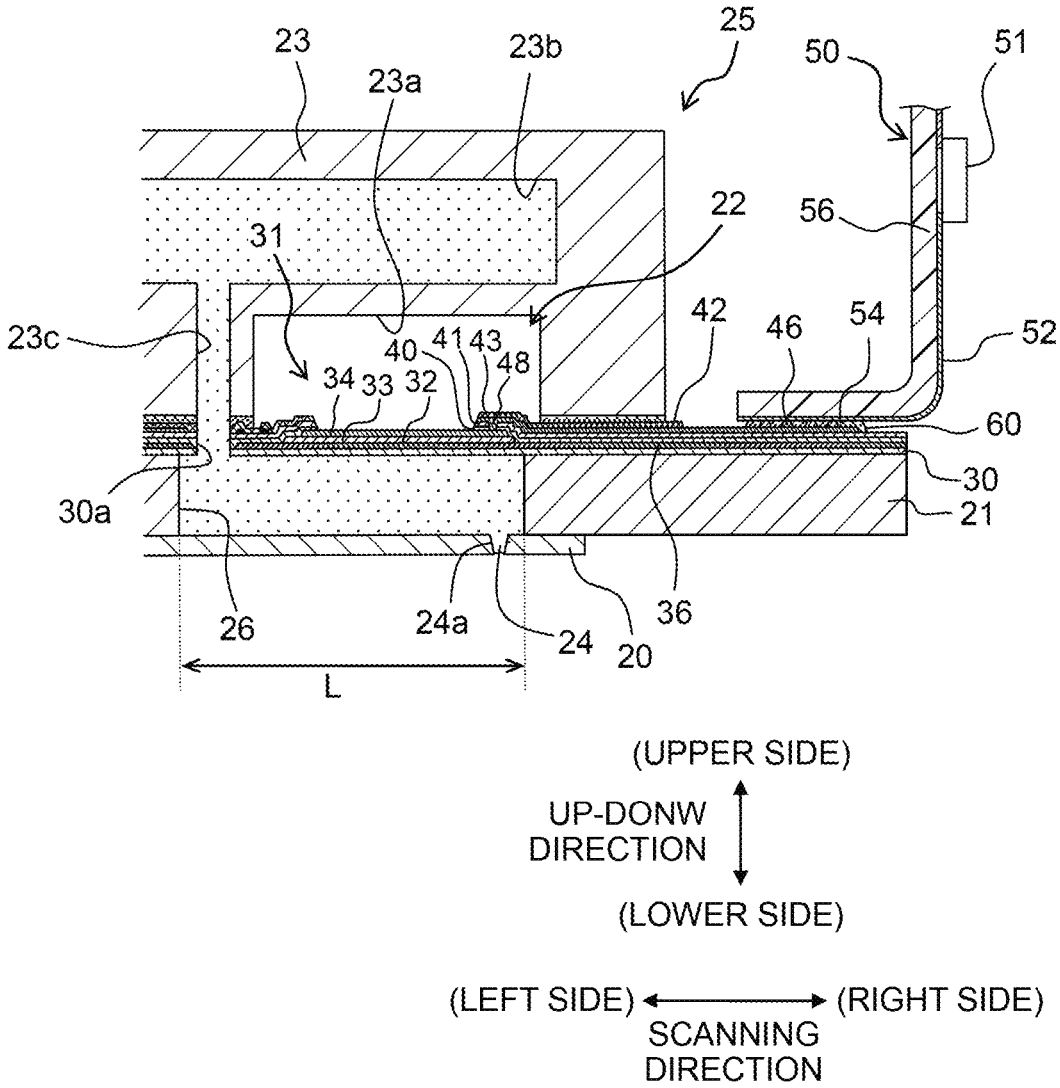
FIG. 5 is a cross-sectional view of FIG. 4, taken along a V-V line.
Figure 6:
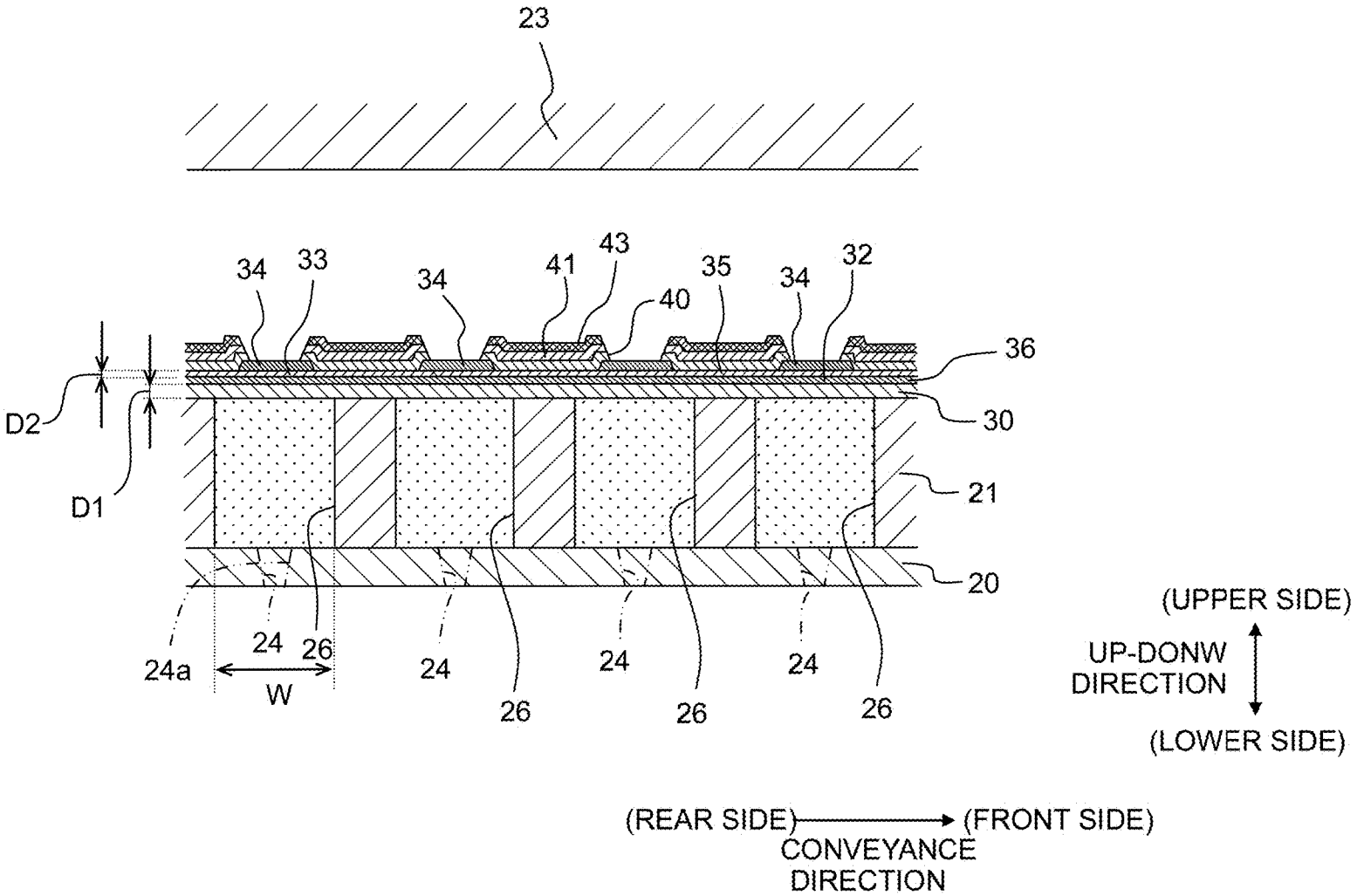
FIG. 6 is a cross-sectional view of FIG. 4, taken along a VI-VI line.

Next, the piezoelectric actuator 22 will be explained in detail. As depicted in FIGS. 2 to 6, the piezoelectric actuator 22 has the above-described vibration film 30, a common electrode 36, a piezoelectric film 33, and a plurality of second electrodes 34. Note that a protective film 40, an insulating film 41 and a trace protective film 43 depicted in the cross-sectional views of FIGS. 5 and 6 are omitted in the illustration in FIGS. 3 and 4 in order to simplify the drawings.

As depicted in FIGS. 5 and 6, a plurality of first electrode 32 are formed in areas, respectively, of the upper surface of the vibration film 30, each of which faces one of the plurality of pressure chambers 26. Further, as depicted in FIG. 6, the plurality of first electrodes 32 are connected to each other via conductive parts 35 arranged on the upper surface of the vibration film 30, at areas not overlapping in the up-down direction with the plurality of pressure chambers 26, respectively. Thus, the plurality of first electrode 32 and the conductive parts 35 connecting the plurality of first electrodes 32 with each other, the common electrode 36 covering substantially the entire area of the upper surface of the vibration film 30 is formed. The common electrode 36 is formed, for example, of platinum (Pt). Further, the thickness of the common electrode 36 is, for example, 0.1 μm.

The piezoelectric film 33 is formed, for example, of a piezoelectric material such as lead zirconate titanate (PZT), etc. Alternatively, the piezoelectric film 33 may be formed of a lead-free piezoelectric material which does not contain the lead. A thickness D2 of the piezoelectric film 33 is, for example, in a range of 1.0 μm to 1.5 μm (not more than 1.5 μm).

As depicted in FIGS. 3, 4 and 6, the piezoelectric film 33 is arranged on the upper surface of the vibration film 30 on which the common electrode 36 is formed. The Piezoelectric film 33 is provided on each of the plurality of pressure chamber rows, and extends in the conveyance direction across the pressure chambers 26 forming each of the pressure chamber rows.

The plurality of second electrodes 34 are arranged on the upper surface of the piezoelectric film 33. Each of the plurality of second electrodes 34 has a rectangular planar shape which is one size smaller than one of the plurality of pressure chambers 26, and overlaps with a central part of one of the plurality of pressure chambers 26 in the up-down direction. The plurality of second electrodes 34 are separated from each other, unlike the plurality of first electrodes 32. That is, the plurality of second electrodes 34 are individual electrodes provided individually on the plurality of the pressure chambers 26, respectively. Each of the plurality of second electrodes 34 is formed, for example, of iridium (Ir) or platinum (Pt). The thickness of each of the plurality of second electrode 34 is, for example, 0.1 μm. Further, a part, of the piezoelectric film 33, which is sandwiched between each of the plurality of first electrodes 32 and one of plurality of second electrodes 34 is polarized.

Then, in such a piezoelectric actuator 22, a combination of parts, of the vibration film 30 and the piezoelectric film 33, respectively, which overlap in the up-down direction with each of the plurality of pressure chambers 26, and one of the plurality of first electrode 32 and one of the plurality of second electrodes 34 overlapping in these parts in the up-down direction forms a piezoelectric element 31. That is, the plurality of piezoelectric elements 31 are aligned in the conveyance direction according to the alignment of the plurality of pressure chambers 26. Thus, the plurality of piezoelectric elements 31 construct two piezoelectric element rows 38 with respect to each of the four color inks, constructing eight piezoelectric element rows 38 in total, according to the alignments of the plurality of nozzles 24 and the plurality of pressure chambers 26. Note that a group of the piezoelectric elements 31 constructed of two piezoelectric element rows 38 corresponding to one color ink among the four color inks is referred to as a piezoelectric element group 39. As depicted in FIG. 3, four piezoelectric element groups 39*k*, 39*y*, 39*c* and 39*m* corresponding to the four color inks, respectively, are arranged side by side in the scanning direction.

As depicted in FIGS. 5 and 6, the piezoelectric actuator 22 further has the protective film 40, the insulating film 41, a plurality of traces 42, and the trace protective film 43.

As depicted in FIG. 5, the protective film 40 is arranged so as to cover the surface of the piezoelectric films 33 except for an area at which a central part of each of the plurality of second electrodes 34 is arranged. One of the main purposes of the protective film 40 is to prevent moisture in air from entering into the piezoelectric film 33. The protective film 40 is formed, for example, of a material having low water permeability exemplified, for example, by an oxide such as alumina ($Al_2O_3$), silicon oxide (SiOx), tantalum oxide (TaOx), etc., or a nitride such as silicon nitride (SiN), etc.

The insulating film 41 is formed on the protective film 40. Although the material of the insulating film 41 is not particularly limited, the insulating film 41 is formed, for example, of silicon dioxide ($SiO_2$). The insulating film 41 is provided so as to enhance the insulating property between the common electrode 36 and the plurality of traces 42 (to be described in the following) which are connected to the plurality of second electrodes 34, respectively.

The plurality of traces 42 which are drawn respectively from the plurality of second electrodes 34 of the piezoelectric elements 31 are formed on the insulating film 41. Each of the plurality of traces 42 is formed, for example, of aluminum (Al). As depicted in FIG. 5, one end part of each of the plurality of traces 42 is arranged at a position overlapping with an end part of one of the plurality of second electrodes 34, and is conducted with one of the plurality of second electrodes 34 by a through conductive part 48 penetrating through the protective film 40 and the insulating film 41.

The plurality of traces 42 corresponding to the plurality of piezoelectric elements 31, respectively, extend while being divided into left and right. Specifically, as depicted in FIG. 3, among the four piezoelectric element groups 39, from the piezoelectric elements 31 forming right two piezoelectric element groups 39*k* and 39*y*, the traces 42 extend to the right side, and from the piezoelectric elements 31 forming left two piezoelectric element groups 39*c* and 39*m*, the traces 42 extend to the left side.

An end part, of each of the plurality of traces 42, on the opposite side to one of the plurality of second electrodes 34 is provided with one of the plurality of driving contacts 46. At each of the left end part and the right end part of the piezoelectric actuator 22, the plurality of driving contacts 46 are aligned in a row in the conveyance direction. In the present embodiment, the nozzles 24 constructing a the nozzle group 27 of one color is aligned at a density of not less than 600 dpi. Further, the traces 42, of the piezoelectric elements 31, corresponding to nozzle groups 27 of the two colors are pulled out to the left side or to the right side. Therefore, at each of the left end part and the right end part of the piezoelectric actuator 22, the driving contacts 46 are aligned with a very narrow spacing distance therebetween which is further half the spacing distance in the alignment of the nozzles 24 in one of the four nozzle groups 27, namely, which is about 21 μm.

Further, with respect to the plurality of driving contacts 46 aligned in a row in the front-rear direction, the two ground contacts 47 are arranged on the both sides, respectively, in the alignment direction, of the plurality of driving contacts 46. One piece of the two ground contacts 47 has a larger contact area than one piece of the plurality of driving contacts 46. Each of the two ground contacts 47 is connected to the common electrode 36 via a conductive part (not depicted in the drawings) which penetrates through the protective film 40 and the insulating film 41 immediately therebelow.

The plurality of driving contacts 46 and the two ground contacts 47 which are arranged on each of the left end part and the right end part of the piezoelectric actuator 22 are exposed from the protective member 23. Further, the two COFs 50 are joined to the left end part and the right end part of the piezoelectric actuator 22, respectively. Each of the plurality of driving contacts 46 is connected to the driver IC 51 via one of the plurality of individual contacts 54 and one of the plurality of individual traces 52 of the COF 50, and the driving signal is supplied from the driver IC 51 to each of the plurality of driving contacts 46. With this, either one of the ground potential and a predetermined driving potential (for example, about 20 V) is selectively applied individually to each of the plurality of second electrodes 34. Each of the two ground contacts 47 is connected to the ground connecting contact 55 of the COF50 to thereby allow the ground potential to be applied to each of the two ground contacts 47.

As depicted in FIG. 5, the trace protective film 43 is arranged so as to cover the plurality of traces 42. The insulating property between the plurality of trace 42 is enhanced by the trace protective film 43. In addition, the trace protective film 43 suppresses any oxidization of a trace material (for example, Al, etc.) forming the plurality of traces 42. The trace protective film 43 is formed, for example, of silicon nitride (SiNx), etc.

Note that in the present embodiment, as depicted in FIGS. 5 and 6, each of the plurality of second electrodes 34 is exposed from the protective film 40, the insulating film 41 and the trace protective film 43, except for a peripheral part thereof. Namely, there is provided such a configuration wherein the deformation of the piezoelectric film 33 is hardly inhibited by the protective film 40, the insulating film 41 and the trace protective film 43.

<Driving Method of Piezoelectric Actuator 22>

Here, a method of discharging the ink from the nozzle 24 by driving the piezoelectric actuator 22 (piezoelectric element 31) will be explained. In the piezoelectric actuator 22, the potential of the second electrode 34 of each of all the piezoelectric elements 31 is previously maintained at the driving potential. In this state, due to the potential difference between the first electrode 32 and the second electrode 34, an electric field in a thickness direction of the piezoelectric film 33 is generated in the piezoelectric film 33; and the piezoelectric film 33 is caused to contract in a direction orthogonal to the thickness direction by this electric field. As a result, the parts, of the vibration film 30 and the piezoelectric film 33, respectively, which overlap in the up-down direction with a pressure chamber 26 included in the plurality of pressure chambers 26 and corresponding to the parts are deformed to project toward the pressure chamber 26, and amounts of the deflection of these parts are greater than those in a case that any difference in the electric potential is not generated between the first electrode 32 and the second electrode 34. Further, in the present embodiment, since the thickness of the piezoelectric film 33 is thin which is in a range of approximately 1.0 μm to approximately 2.0 μm, a large electric field is generated in the piezoelectric film 33, which in turn causes the amounts of deflection of the parts of the vibration film 30 and the piezoelectric film 33 to be great.

In a case of causing the ink to be discharged from a certain nozzle 24 among the plurality of nozzles 24, the driver IC 51 switches the potential of a second electrode 34 of a certain piezoelectric element 31 included in the plurality of piezoelectric elements 31 and corresponding to the certain nozzle 24 to the ground potential once, and then returns the potential to the driving potential. In a case that the potential of the second electrode 34 is switched to the ground potential, the first electrode 32 and the second electrode 34 have a same potential, and thus the electric field is not generated, which in turn reduces the amounts of deflection of the vibration film 30 and the piezoelectric film 33 to be small. Afterwards, in a case that the potential of the second electrode 34 is returned to the driving potential, the amounts of deflection of the vibration film 30 and the piezoelectric film 33 are increased, thereby reducing the volume of the certain pressure chamber 26 to be small. As a result, the pressure of the ink in the certain pressure chamber 26 is increased, thereby causing the ink to be discharged from a certain nozzle 24 included in the plurality of nozzles 24 and communicating with the certain pressure chamber 26.

Further, in the present embodiment, in a case that recording is performed on the recording sheet 100 in the printer 1, the driver IC 51 drives the piezoelectric element 31 at a driving frequency which is not less than 50 kHz. Here, the phrase "to drive the piezoelectric element 31 at a driving frequency of not less than 50 kHz" means that an operation of switching the potential of the second electrode 34 of the piezoelectric element 31 once to the ground potential and then of returning the potential to the driving potential is performed not less than 50,000 times per second.

<Relationship between Inclination angle θ and Area S>

Next, the relationship between the inclination angle θ with respect to the up-down direction of the inner wall surface 24*a* of the nozzle 24 as described above and the area S, of the pressure chamber 26, which is projected in the up-down direction will be explained. In the present embodiment, the inclination angle θ and the area S satisfy the relationship of $\theta+1.5\times10^{-4}\times S>11$. In the following, this relationship will be explained in detail.

Here, as in the present embodiment, in a case that the inner wall surface 24*a* of the nozzle 24 has a tapered shape which is inclined with respect to the up-down direction, the surface area of a meniscus M of the ink in the nozzle 24 becomes greater in a case that the meniscus M of the ink in the nozzle 24 is located on an upper side than another case that the meniscus M of the ink in the nozzle 24 is located on a lower side, as appreciated by comparing FIG. 7A and FIG. 7B. Since the meniscus M of the ink in the nozzle 24 has a property to make the surface area to be as small as possible, the meniscus M intends to remain at an lower end part of the nozzle 24 (at a position of FIG. 7A).

Figure 7C:
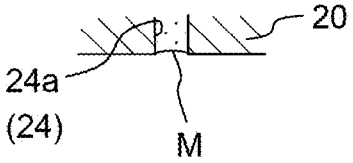
FIG. 7C is a view for explaining the meniscus of the ink in the nozzle in a case that the diameter of the nozzle is constant.
Figure 7D:
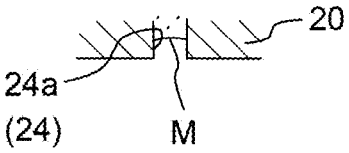
FIG. 7D is a view indicating a state, in the case that the diameter of the nozzle is constant, that the meniscus of the ink in the nozzle is located above that depicted in FIG. 7C.

In contrast, in a case that, unlike the present embodiment, the inner wall surface 24*a* of the nozzle 24 is parallel to the up-down direction (θ=0), the surface area of the meniscus M of the ink in the nozzle 24 hardly changes even if the meniscus M of the ink inside the nozzle 24 is moved upward and downward, as appreciated by comparing FIG. 7C and FIG. 7D.

Namely, in a case that the inner wall surface 24*a* of the nozzle 24 is inclined with respect to the up-down direction, the meniscus M of the ink in the nozzle 24 is less likely to move upward than in another case that the inner wall surface 24*a* of the nozzle 24 is parallel to the up-down direction. Therefore, in order to stabilize the meniscus M of the ink in the nozzle 24, it is desired that the inner wall surface 24*a* of the nozzle 24 is inclined with respect to the up-down direction, rather than being parallel to the up-down direction.

Further, TABLE 1 as follows indicates a result of an experiment as to whether or not the ink is normally discharged from the nozzle 24 in a case that the piezoelectric element 31 is driven at a various kinds of driving frequencies in a plurality of types of the ink-jet head 4 having different inclination angles θ and natural frequencies. The term "natural frequency" used here refers to a natural frequency of a pressure wave vibration generated in a case that the pressure is applied to the ink in the channel, and is determined by the design size of the channel, etc. An ink-jet product can be driven efficiently by synchronizing a driving pulse of the actuator drive with this natural frequency. In TABLE 1, reference symbol "G" indicates that ink has was discharged normally from the nozzle 24, and reference symbol "NG" indicates that the ink was not discharged normally from the nozzle 24. Here, the phrase that "the ink was discharged normally" means that the liquid droplets were discharged periodically and stably in accordance with the driving pulses. On the other hand, the phrase that "the ink was not discharged normally" means that liquid droplets were not formed stably in accordance with the driving pulses, such as a situation that the ink was discharged in a mist-like manner. Further, TABLE 1 indicates, based on the above-described result, for each the ink-jet heads 4, a threshold driving frequency fth which is a maximum driving frequency capable of normally discharging the ink from the nozzle 24.

TABLE 1

| | | Inclination Angle θ [°] | | | | | | | |
|---|---|---|---|---|---|---|---|---|---|
| | | 0 | 0 | 0 | 0 | 6 | 6 | 9 | 9 |
| | | Length of Pressure Chamber [μm] | | | | | | | |
| | | 780 | 590 | 590 | 590 | 590 | 590 | 590 | 780 |
| | | Natural Frequency fe [kHz] | | | | | | | |
| | | 107.181 | 137.3 | 125 | 124.8 | 133.5 | 152 | 148.1 | 120.2 |
| Driving Frequency [kHz] | 1.0 | G | G | G | G | G | G | G | G |
| | 2.0 | G | G | G | G | G | G | G | G |
| | 3.0 | G | G | G | G | G | G | G | G |
| | 4.0 | G | G | G | G | G | G | G | G |
| | 5.0 | G | G | G | G | G | G | G | G |
| | 6.0 | G | G | G | G | G | G | G | G |
| | 7.0 | G | G | G | G | G | G | G | G |
| | 8.0 | G | G | G | G | G | G | G | G |
| | 9.0 | G | G | G | G | G | G | G | G |
| | 10.0 | G | G | G | G | G | G | G | G |
| | 15.0 | G | G | G | G | G | G | G | G |
| | 20.0 | G | G | G | G | G | G | G | G |
| | 25.0 | G | G | G | G | G | G | G | G |
| | 30.0 | G | G | G | G | G | G | G | G |
| | 35.0 | G | G | G | G | G | G | G | G |
| | 40.0 | G | G | G | G | G | G | G | G |
| | 45.0 | G | G | NG | NG | G | G | G | G |
| | 50.0 | G | G | NG | NG | G | G | G | G |
| | 55.0 | NG | G | NG | NG | G | G | G | G |
| | 60.0 | NG | G | NG | NG | G | G | G | G |
| | 65.0 | G | NG | NG | NG | G | G | G | G |
| | 70.0 | G | NG | NG | NG | G | G | G | G |
| | 75.0 | NG | NG | NG | NG | G | G | G | G |
| | 80.0 | NG | NG | NG | NG | G | G | G | G |
| | 85.0 | NG | NG | NG | NG | G | G | G | G |
| | 90.0 | G | G | NG | NG | NG | G | G | G |
| | 95.0 | NG | NG | NG | NG | NG | G | G | G |
| | 100.0 | NG | NG | NG | NG | NG | G | G | G |
| | 125.0 | NG | NG | NG | NG | G | NG | G | G |
| | 150.0 | NG | NG | NG | NG | NG | G | G | G |
| Threshold driving frequency fth [kHz] | | 55 | 65 | 45 | 45 | 90 | 125 | 150 | 150 |

In each of the ink-jet head 4 which were manufactured, the diameter of the nozzle 24 was made to be in a range of 18 μm to 22 μm. Further, the plurality of nozzles 24 forming the nozzle row 28 were aligned at 300 dpi. Furthermore, the width W of the pressure chamber 26 was made to be 65 μm.

Moreover, the length L of the pressure chamber 26 was made to be 590 μm or 780 μm. Further, the diameter of the throttle channel 23*c* was made to be in a range of 38 μm to 42 μm. Furthermore, the thickness of the vibration film 30 was made to be 1.4 μm. Moreover, the thickness of the piezoelectric layer 33 was made to be 1 μm. Note that TABLE 1 indicates whether the length L of the pressure chamber 26 is 590 μm or 780 μm, with respect to each of the ink-jet heads 4. Further, in each of the ink-jet heads 4, the inertance of the nozzle 24 was in a range of 1.1 kg/cm$^4$ to 1.9 kg/cm$^4$. Furthermore, the inertance of the throttle channel 23*c* was in a range of 3.2 kg/cm$^4$ to 3.9 kg/cm$^4$.

Figure 8:
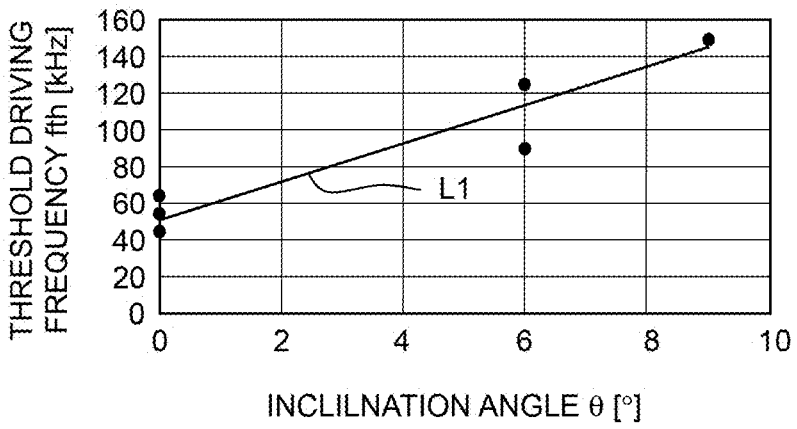
FIG. 8 is a view indicating a relationship between an inclination angle of an inner wall surface of the nozzle and a threshold driving frequency.

From the result indicated in TABLE 1, it is appreciated that the threshold driving frequency fth depends on the inclination angle θ of the nozzle 24. Further, FIG. 8 plots the relationship between the inclination angle θ and the threshold driving frequency fth based on the results of TABLE 1. Then, based on this result, a relational expression (a) as indicated below (an expression of a straight line L1 in FIG. 8) was calculated by the least squares method, as the relationship between the inclination angle θ and the threshold driving frequency fth. Under a condition that the drive frequency is not more than the threshold driving frequency fth, the ink can be discharged normally from the nozzle 24.

$$fth=10\theta+50 \quad \text{(a)}$$

Figure 9:
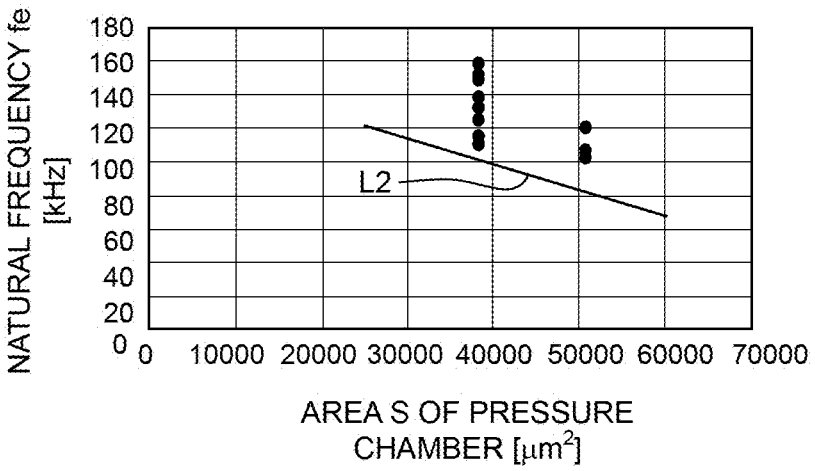
FIG. 9 is a view indicating a relationship between an area of a pressure chamber and a natural frequency.

On the other hand, the piezoelectric element 31 is usually driven at a frequency which is close to the natural frequency fe determined by the size of the pressure chamber 26, etc., in order to drive the piezoelectric element 31 efficiently. FIG. 9 is a plot of the relationship between the area S of the pressure chamber 26 and the natural frequency fe in the plurality of ink-jet heads 4 manufactured as described above. Then, on the basis of this result, a relational expression (b) as indicated below (an expression of a straight line L2 in FIG. 9) was calculated, as the relationship between the area S and a smallest natural frequency fe while also considering any variation in the manufacturing.

$$fe=-0.0015\times S+160 \quad \text{(b)}$$

In a case that the piezoelectric element 31 is driven at the natural frequency fe, under a condition that fe<fth is satisfied, the ink can be normally discharged or ejected from the nozzle 24. From this fact and the relational expressions (a) and (b) as described above, it is appreciated that the ink can be discharged or ejected normally from the nozzle 24 under the condition that a relationship (c) as indicated below is satisfied.

$$\theta+1.5\times10^{-4}\times S>11 \quad \text{(c)}$$

<Contact Angle of Inner Wall Surface 24*a* of Nozzle 24 with Respect to Ink>

Next, the contact angle of the inner wall surface 24*a* of the nozzle 24 with respect to the ink will be explained. FIGS. 10A to 10D each depict, in a simulation in which the piezoelectric element 31 is continuously driven at a frequency of about 100 kHz, a maximum displacement position, of the meniscus M of the ink in the nozzle 24, from a position of the meniscus M in a case that the piezoelectric element 31 is not driven (initial position of the meniscus). An arrow in each of FIGS. 10A to 10D indicates a position of an end part of the meniscus located on the inner wall surface 24*a* of the nozzle 24; at the meniscus initial position (not depicted in the drawings), the end part of the meniscus is substantially coincident with the nozzle surface. Note that each of FIGS. 10A to 10D indicates a half of the cross section of the nozzle 24.

Figure 10A:
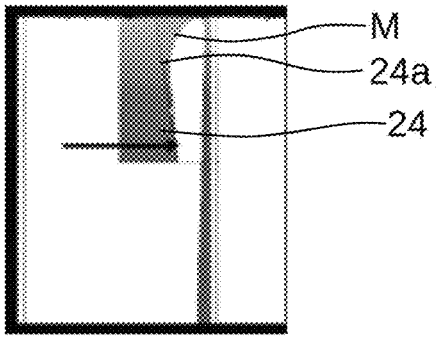
FIG. 10A is a view indicating a result of a simulation of a maximum displacement position of the meniscus in a case that the nozzle is tapered and that a contact angle of the inner wall surface of the nozzle with respect to the ink is 20°.
Figure 10B:
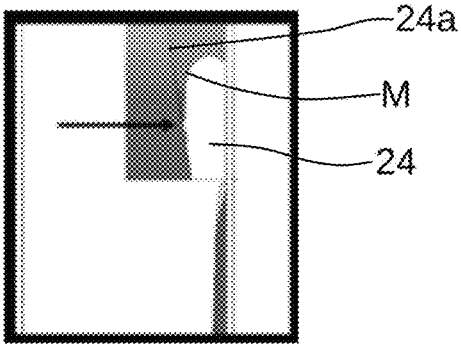
FIG. 10B is a view corresponding to FIG. 10A in a case that the contact angle of the inner wall surface of the nozzle with respect to the ink is 80°.
Figure 10C:
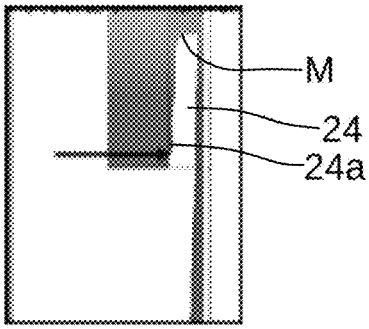
FIG. 10C is a view indicating a result of a simulation of the maximum displacement position of the meniscus in a case that the diameter of the nozzle is constant and that the contact angle of the inner wall surface of the nozzle with respect to the ink is 20°.
Figure 10D:
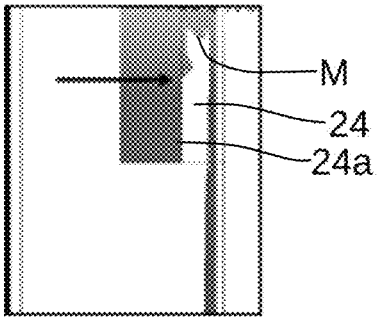
FIG. 10D is a view corresponding to FIG. 10C in a case that the contact angle of the inner wall surface of the nozzle with respect to the ink is 80°.

FIGS. 10A and 10B each indicate the result of a case that the inner wall surface 24*a* of the nozzle 24 is inclined with respect to the up-down direction (θ=9°), wherein FIG. 10A indicates a case that the contact angle of the inner wall surface 24*a* with respect to the ink is 20°, and FIG. 10B indicates a case that the contact angle of the inner wall surface 24*a* with respect to the ink is 80°. FIGS. 10C and 10D each indicate the result of a case that the inner wall surface 24*a* of the nozzle 24 is parallel to the up-down direction (θ=9°), wherein FIG. 10C indicates a case that the contact angle of the inner wall surface 24*a* with respect to the ink is 20°, and FIG. 10D indicates a case that the contact angle of the inner wall surface 24*a* with respect to the ink is 80°.

In FIG. 10A, the end part of the meniscus is located on a side which is close to the surface of the nozzle 24; it is appreciated that the meniscus is not deviated greatly from the initial position also during a continuous driving, and thus is stable. In FIG. 10B, the end part of the meniscus is separated away from the surface of the nozzle 24 during the continuous driving, as compared with the case indicated in FIG. 10A; it is appreciated, however, that the meniscus is not deviated greatly from the initial position, and thus is stable.

On the other hand, in FIG. 10C, the end part of the meniscus is located on a side which is close to the surface of the nozzle 24; it is appreciated that the meniscus is not deviated greatly from the initial position also during the continuous driving, and thus is stable. On the other hand, in FIG. 10D, the end part of the meniscus is located at a position far from the surface of the nozzle 24; it is appreciated that the position of the meniscus is unstable during the continuous driving.

Further, when comparing FIGS. 10A and 10B with FIGS. 10C and 10D, in the case that the inner wall surface 24*a* is inclined with respect to the up-down direction, it is appreciated that the end part of the meniscus is more stable during the continuous driving than in the case that the inner wall surface 24*a* is parallel to the up-down direction. Further, from the results of FIGS. 10A and 10B, in the case that the contact angle, with respect to the ink, of the inner wall surface 24*a* of the nozzle 24 is not more than 80°, it is appreciated that the end part of the meniscus is stabilized during the continuous driving.

<Effect>

Generally, in a case that the area, of the pressure chamber 26, which is projected in the up-down direction is small, the natural frequency becomes high. In this situation, in a case that the driving pulse of the actuator is synchronized with the natural frequency in order to drive the actuator efficiently as described above, the actuator is driven by a certain driving pulse and thus the meniscus in the nozzle 24 is made to vibrate. Afterward, the actuator is driven by a next driving pulse before the vibration of the meniscus is sufficiently damped or attenuated, and thus this leads to such a situation that the discharge of the ink from the nozzle 24 is likely to become unstable.

In contrast, in the present embodiment, in a case that the area S, of the pressure chamber 26, which is projected in the up-down direction is as small as not more than 50,000 μm$^2$, the angle of inclination θ, with respect to the up-down direction, of the inner wall surface 24*a* of the nozzle 24 is set so that the angle of inclination θ and the area S satisfy the relationship of $\theta+1.5\times10^{-4}\times S>11$. With this, as described above, even in the case that the piezoelectric element 31 is driven at a high driving frequency, the ink can be stably discharged or ejected from the nozzle 24.

Further, in the case that the thickness of the piezoelectric layer 33 is as thin as not more than 1.5 μm, although the deformation efficiency at the time of driving the piezoelectric element 31 is increased to be high, the compliance of the piezoelectric layer 33 is increased. Due to this, the pressure chamber 26 needs to be miniaturized in order to drive the piezoelectric element 31 at a high driving frequency; in such a case, the area S of the pressure chamber 26 is reduced to be small. In the present embodiment, the inclination angle θ is set so as to satisfy the above-described relationship also in such a case to thereby make it possible to discharge or eject the ink stably from the nozzle 24 in a case that the piezoelectric element 31 is driven at a high driving frequency.

Further, in the present embodiment, the length in the scanning direction of the pressure chamber 26 is relatively small, such as not more than 1000 μm. In such a case, the inclination angle θ is set so as to satisfy the above-described relationship. By doing so, it is possible to discharge or eject the ink stably from the nozzle 24 in a case that the piezoelectric element 31 is driven at a high driving frequency.

Further, in the present embodiment, the width W (length in the conveyance direction) of the pressure chamber 26 is relatively small, such as not more than 80 μm. In such a case, the inclination angle θ is set so as to satisfy the above-described relationship. By doing so, the ink can be stably discharged or ejected from the nozzle 24 in a case that the piezoelectric element 31 is driven at a high driving frequency.

Further, in the present embodiment, the plurality of nozzles 24 and the plurality of pressure chambers 26 having the small area S are arranged at a high density of not less than 300 dpi in the conveyance direction as described above so as to make the size of the ink-jet head 4 to be small. In such a case, the inclination angle θ is set so as to satisfy the above-described relationship, thereby making it possible to discharge or eject the ink stably from the nozzle 24 in a case that the piezoelectric element 31 is driven at a high driving frequency.

Further, in the present embodiment, by setting the inclination angle θ so as to satisfy the above-described relationship, the ink can be stably discharged or ejected from the nozzle 24 even in a case that the piezoelectric element 31 is driven at a particularly high driving frequency such as not less than 50 kHz.

Further, in the present embodiment, at least the inertance of the nozzle 24 is in the range of 1.1 kg/cm$^4$ to 1.9 kg/cm$^4$, as described above. In such a case, by setting the inclination angle θ so as to satisfy the above-described relationship, it is possible to discharge or eject the ink stably from the nozzle 24 in a case that the piezoelectric element 31 is driven at a high driving frequency.

Furthermore, in the present embodiment, as described above, at least the inertance of the throttle channel 23*c* is in the range of 3.2 kg/cm$^4$ to 3.9 kg/cm$^4$. In such a case, by setting the inclination angle θ so as to satisfy the above-described relationship, it is possible to discharge or eject the ink stably from the nozzle 24 in a case that the piezoelectric element 31 is driven at a high driving frequency.

Moreover, a processing for forming tapered nozzles 24 in a nozzle plate made of silicon is generally complicated. In the present embodiment, since the nozzle plate 20 is made of silicon, the processing for forming the tapered nozzles 24 in the nozzle plate 20 made of silicon is complicated. However, the tapered nozzles 24 are formed in the nozzle plate 20 such that the inclination angle θ of the inner wall surface 24*a* satisfies the above-described relationship. With this, the ink is allowed to be discharged or ejected stably from the nozzles 24 in a case that the piezoelectric elements 31 are driven at a high driving frequency.

Further, in the present embodiment, as described above, since the contact angle of the inner wall surface of the nozzle is not more than 80°, the ink can be discharged or ejected stably from the nozzle 24 in a case that the piezoelectric element 31 is driven at a high driving frequency.

<Modifications>

The embodiment of the present disclosure is explained above. The present disclosure, however, is not limited to the above-described embodiment. Various changes or modifications may be made to the embodiment, without departing from the range of the claims.

In the above-described embodiment, although the contact angle of the inner wall surface 24*a* of the nozzle 24 with respect to the ink was not more than 80°, the present disclosure is not limited to this. The contact angle may be greater than 80°.

Further, although the nozzle plate 20 of the above-described embodiment is made of silicon, the present disclosure is not limited to this. The nozzle plate 20 may be made of another material such as a synthetic resin material, a metallic material, etc.

In the above-described embodiment, although the inertance of the throttle channel 23*c* is in the range of 3.2 kg/cm$^4$ to 3.9 kg/cm$^4$, the present disclosure is not limited to this. The inertance of the throttle channel 23*c* may be less than 3.2 kg/cm$^4$ or may be greater than 3.9 kg/cm$^4$.

Further, the ink channel in the inside of the ink-jet head 4 may be different from the configuration, of the embodiment described above, including a nozzle and a pressure chamber communicating with the nozzle.

Further, in the above-described embodiment, although the inertance of the nozzle 24 is in the range of 1.1 kg/cm$^4$ to 1.9 kg/cm$^4$, the present disclosure is not limited to this. The inertance of the nozzle 24 may be less than 1.1 kg/cm$^4$ or may be greater than 1.9 kg/cm$^4$.

Further, in the above-described embodiment, although the driving frequency of the piezoelectric element 31 is made to be the driving frequency which is not less than 50 kHz, the present disclosure is not limited to this. The driving frequency of the piezoelectric element 31 may be less than 50 kHz.

Further, in the above-described embodiment, although the nozzles 24 forming each of the nozzle rows 28 and the pressure chambers 26 corresponding to the nozzles 24, respectively, are aligned at the densities of not less than 300 dpi, the present disclosure is not limited to this. The nozzles 24 forming each of the nozzle rows 28 and the pressure chambers 26 corresponding to the nozzles 24, respectively, may be aligned at densities of less than 300 dpi.

Furthermore, in the above-described embodiment, although the width W (length in the conveyance direction) of the pressure chamber 26 is not more than 80 μm, the present disclosure is not limited to this. The width W of the pressure chamber 26 may be greater than 80 μm.

Moreover, in the above-described embodiment, although the length L (length in the scanning direction) of the pressure chamber 26 is not more than 1000 μm, the present disclosure is not limited to this. The length L of the pressure chamber 26 may be greater than 1000 μm.

Further, the shape of the pressure chamber 26 is not limited to being rectangular with the scanning direction as the longitudinal direction thereof. The shape of the pressure chamber 26 may be a shape which is different from the rectangular shape in which the scanning direction is the longitudinal direction thereof, or may be a shape in which the conveyance direction is the longitudinal direction thereof, or may be a shape in which the length in the scanning direction and the length in the conveyance direction are the same.

Further, in the above-described embodiment, although the thickness D2 of the piezoelectric layer 33 is not more than 1.5 μm, the present disclosure is not limited to this. The thickness D2 of the piezoelectric layer 33 may be greater than 1.5 μm.

Furthermore, in the foregoing, although the explanation has been given about the example in which the present disclosure is applied to the ink-jet head which discharges the ink from the nozzle, the present disclosure is not limited to this. The present disclosure is also applicable to a liquid discharging head which is different from the ink-jet head and which discharges a liquid, different from the ink, from the nozzle.

What is claimed is:

1. A liquid discharging head comprising:

a channel unit having a liquid channel which includes:

a nozzle arranged at an end part, of the channel unit, on one side in a first direction; and a pressure chamber arranged at an end part, of the channel unit, on the other side in the first direction and communicating with the nozzle; and a piezoelectric element including:

a vibration plate arranged on a surface, of the channel unit, on the other side in the first direction and covering the pressure chamber; and a piezoelectric layer arranged on a surface, of the vibration plate, on the other side in the first direction, wherein an area, of the pressure chamber, which is projected in the first direction is not more than 50000 $\mu m^2$, a diameter of the nozzle is increased from the one side toward the other side in the first direction, and a relationship of: $\theta+1.5\times10^{-4}\times S>11$ is satisfied, provided that θ is an inclination angle of an inner wall surface of the nozzle with respect to the first direction, and that the area of the pressure chamber is S $\mu m^2$.

2. The liquid discharging head according to claim 1, wherein a length in the first direction of the piezoelectric layer is not more than 1.5 μm.

3. The liquid discharging head according to claim 1, wherein the pressure chamber has a length, in a second direction orthogonal to the first direction, which is longer than a length, in a third direction orthogonal to both the first direction and the second direction, and the length in the second direction of the pressure chamber is not more than 1000 μm.

4. The liquid discharging head according to claim 3, wherein the length in the third direction of the pressure chamber is not more than 80 μm.

5. The liquid discharging head according to claim 1, wherein the pressure chamber has a length, in a second direction orthogonal to the first direction, which is longer than a length, in a third direction orthogonal to both the first direction and the second direction, and the channel unit has: nozzles including the nozzle and arranged side by side in the third direction at a density of not less than 300 dpi; and pressure chambers including the pressure chamber and arranged side by side in the third direction at a density of not less than 300 dpi.

6. The liquid discharging head according to claim 1, further comprising a driver IC configured to drive the piezoelectric element, wherein the driver IC drives the piezoelectric element at a drive frequency of not less than 50 kHz.

7. The liquid discharging head according to claim 1, wherein inertance of the nozzle is in a range of 1.1 $kg/cm^4$ to 1.9 $kg/cm^4$.

8. The liquid discharging head according to claim 1, wherein the liquid channel includes:

nozzles including the nozzle;

pressure chambers including the pressure chamber and corresponding to the nozzles, respectively;

a common channel common to the pressure chambers; and throttle channels provided corresponding to the pressure chambers, respectively, and each connecting one of the pressure chambers and the common channel, and inertance of each of the throttle channels is in a range of 3.2 $kg/cm^4$ to 3.9 $kg/cm^4$.

9. The liquid discharging head according to claim 1, wherein the channel unit includes a nozzle plate in which the nozzle is formed and which is made of silicon.

10. The liquid discharging head according to claim 1, wherein a contact angle of an inner wall surface of the nozzle, with respect to liquid to be discharged from the nozzle, is not more than 80 degrees.

* * * * *